United States Patent [19]

Bean et al.

[11] Patent Number: 4,479,641

[45] Date of Patent: Oct. 30, 1984

[54] PAPER HANDLING SYSTEM

[75] Inventors: Harley F. Bean, Grapevile; Daniel T. Noonan, Irving, both of Tex.

[73] Assignee: The Mead Corporation, Dayton, Ohio

[21] Appl. No.: 355,426

[22] Filed: Mar. 8, 1982

[51] Int. Cl.[3] ..... B42B 2/00

[52] U.S. Cl. ..... 270/53; 271/186; 271/214; 355/14 SH; 414/52

[58] Field of Search ..... 414/52, 54; 271/186, 271/214; 355/14 SH; 227/99, 103; 270/53

[56] References Cited

U.S. PATENT DOCUMENTS

| | | | |
|---|---|---|---|
| 2,540,972 | 2/1951 | Wagner, Jr. et al. | 93/93 |
| 3,164,270 | 1/1965 | Kinker | 214/6 |
| 3,265,274 | 8/1966 | Burnell | 227/7 |
| 3,630,607 | 12/1971 | Korn et al. | 355/6 |
| 3,685,712 | 8/1972 | Turner et al. | 227/3 |
| 3,719,266 | 3/1973 | Korn et al. | 198/35 |
| 3,735,978 | 5/1973 | Turner et al. | 271/88 |
| 3,822,793 | 7/1974 | Stobb | 214/6 H |
| 3,830,590 | 8/1974 | Harris et al. | 355/14 |
| 3,915,089 | 10/1975 | Schubert | 101/232 |
| 3,972,525 | 8/1976 | Foster et al. | 271/221 |
| 3,988,019 | 10/1976 | Achelpohl | 271/180 |
| 4,019,435 | 4/1977 | Davis | 101/232 |
| 4,027,870 | 6/1977 | Frech et al. | 271/65 |
| 4,045,014 | 8/1977 | Karlsson | 271/8 R |
| 4,047,713 | 9/1977 | Snellman et al. | 271/221 |
| 4,134,672 | 1/1979 | Burlew | 227/103 X |
| 4,175,314 | 11/1979 | Spehrley, Jr. | 29/432.1 |
| 4,204,671 | 5/1980 | Pessina et al. | 271/186 |
| 4,295,733 | 10/1981 | Janssen | 355/14 SH |
| 4,358,197 | 11/1982 | Kukucka | 355/14 SH |

*Primary Examiner*—Richard A. Schacher

*Attorney, Agent, or Firm*—Biebel, French & Nauman

[57] ABSTRACT

A paper handling system is used in combination with a duplicator of the type having a printing station and means for conveying printed sheets from the printing station. The paper handling system includes a gravity feed accumulator for receiving sheets from the sheet conveying means and collecting them in a set, a finishing station positioned at the lower level of the accumulator for receiving collected sets from the accumulator and including a stapling device for binding together the sheets of the set, an elevator which communicates with the finishing station to receive bound pamphlets therefrom, and a stacking device which is positioned above the finishing station and communicates with the elevator for receiving pamphlets and arranging them in a stack. The stacking device includes an upper level stacking station, a discharge station located beneath the stacking station, and a movable tray which is capable of being indexed between the upper level and the discharge station. The discharge station includes a discharge conveyor which transports the offset stack of sets of sheets from the tray to a shelf positioned at an optimum height above the floor of the work area within which the paper handling system is located.

8 Claims, 7 Drawing Figures

PAPER HANDLING SYSTEM

BACKGROUND OF THE INVENTION

1. Field of the Invention

The invention relates to paper handling systems, and more particularly to paper handling systems used in combination with duplicating machines for receiving printed sheets in serial paginated sequence and presenting the sheets in a finished stack of bound pamphlets.

2. Prior Art

In many office environments, it is necessary to augment a duplicating machine with additional equipment which processes the output of the duplicating machine. For example, it is often necessary to collect the paper output of a duplicating machine into stacked sets of sheets, bind the sheets of each set together into pamphlets by staples or other means, then stack the pamphlets in a suitable fashion for presentation to a user. In the typical prior art duplicating system the printed sheets are produced in common page sets which must be collated by appropriate collation means prior to binding into pamphlet form. Recently, however, advances in the data processing field have made it possible to scan and load entire multi page documents into memory and to perform collation electronically. A duplicator which is equipped for electronic collation prints pamphlet pages in serial sequence. Thereafter the pages must be collected into pamphlet defining sets and suitably bound. Ink jet printers and electrostatic printers of many types are suitable for use in such an application.

Many devices have been developed to collect, bind, and stack the sheet output from a duplicating machine. For example, U.S. Pat. No. 3,265,274 is directed to a pamphlet assembly and stapling machine. A collator feeds sheets onto downwardly inclined conveyor belts which deposit them on a horizontally running belt system. The horizontally running belts include pairs of upwardly extending pins which engage the trailing edges of the individual sheets as they are carried on the belt. The sheets pass beneath a cover feed station in which a vacuum assembly places a relatively rigid cover upon the sheets as they pass beneath. The sheets then are urged against stops where they are collected into a set and bound into pamphlets by a stapling machine. The pamphlets are then transported to a folding machine which ultimately deposits them on a downwardly inclined receiving platform.

A disadvantage with this device is that the various components of the system are arranged linearly and on about the same plane. Therefore, the device requires a large amount of horizontal space. This factor reduces the capability of such a device to be utilized in a standard office environment. In addition, the downwardly inclined tray of the device does not provide a surface upon which pamphlets may be stacked in an offset fashion. Rather, the pamphlets lie upon the tray in a shingled, overlapping relationship, making it difficult to transport them in bulk to another station by a user.

Another example of a paper handling system is disclosed in U.S. Pat. No. 3,685,712. This patent is directed to a stapling apparatus in which sheets are received serially from a duplicating machine and deposited on a tray forming a portion of a receiving tray assembly. The sheets are urged against a gate mounted to the lid above the tray and are collected there into sets. The sets are bound into pamphlets on the tray and then conveyed to a downwardly inclined tray which indexes downwardly as successive pamphlets are deposited upon it.

This type of device possesses several disadvantages. The collecting mechanism is complicated, requiring flexible paddle wheels to orient the sheets in a stacked relation prior to stapling. The device includes an offset stacking apparatus mounted in the lid which presents problems in the construction and orientation of the offset stacking apparatus requiring close tolerances to assure proper registration of the lid above the tray supporting the finished pamphlets. Furthermore, the tray supporting the finished pamphlets which indexes downwardly must be unloaded from the top requiring the user to reach over the sides of the apparatus and lift out the stacked pamphlets, after opening the lid of the apparatus, which exposes the interior components to external sources of pollution and entanglement with clothing or hair of the user.

Accordingly, there is a need for a paper handling system in which paper sheets are collected into sets by an accumulator, the sets are transported to a finishing station where they are bound into pamphlets, then to a stacking station where they are stacked either uniformly or offset, and then to a discharge station where the stack is presented to a user at an optimum elevation which obviates the need for reaching inside an enclosure to remove the stack. In addition, the components of each portion of the paper handling system must be of simplified construction to eliminate high costs of manufacturing and the need for parts having close tolerances. There is also a need for a system which possesses desirable height, width, and length dimensions making it suitable for placement in a conventional office environment.

SUMMARY OF THE INVENTION

The present invention provides a paper handling system which does not require excessive space in a vertical or height dimension. Indeed, the top surface of the invention may be utilized by the user to place copies for perusal or used temporarily to stack other paper or supplies. The system also requires minimal room in a width and length dimension, making it suitable for use in a conventional office environment. The system receives sheets serially from a duplicating machine in a sideward direction, and delivers an offset stack of bound sets in a forward direction normal to the sideward direction, providing a generally L-shaped path of paper travel. This feature enhances the usefulness of the system in combination with duplicating machines which typically have the shape in elevation of an elongated rectangle. Since these duplicating devices often are positioned within offices so that their length dimension is against a wall, the offset stack of bound pamphlets may be presented conveniently to a user in a direction normal to the wall against which the duplicating device is placed.

The paper handling system optimizes the use of space in which its components are placed because it utilizes a sheet accumulator having a downwardly inclined ramp from the output conveyor system of the duplicator to a finishing station where the sets are bound into pamphlets, and a stacking assembly which is positioned above the finishing station, thereby conserving lateral space. This is contrasted to prior art devices in which the separate stations of the system are spread along a single plane and may comprise portions of a continuous, horizontal belt system. Another advantage of the system of the present invention is that its use of a gravity feed accumulator which utilizes the force of gravity to collect the sheets into a set, rather than mechanical means reduces the overall complexity and cost of the system.

The paper handling system of the present invention also provides delivery of a stack of pamphlets at an optimum height above the floor of the work area. This eliminates the need for most users to bend over excessively or to reach inside an enclosure to remove a stack of pamphlets; an uncomfortable task for a user of slight build or reduced flexibility.

The paper handling system of the present invention is used with a duplicating machine of the type having a printer and means for conveying sheets of paper from the printer to a sheet feed station. The system preferably comprises a downwardly-inclined gravity feed accumulator for receiving sheets serially from the sheet feed station in a sideward direction and collecting them into a set, a finishing station positioned below the sheet feed station and communicating with the accumulator for receiving the sets sidewardly from the accumulator and including a stapler where they are bound together into a pamphlet, a top-loading stacker superposed to the finishing station, and an elevator having an inlet end communicating with the finishing station and an outlet end communicating with the stacker to receive the pamphlets rearwardly from the finishing station, convey pamphlets upwardly from the finishing station to the stacker, and feed the pamphlets in a forward direction to the stacker which stacks the pamphlets and conveys the stack to a discharge station, located at an elevation intermediate the finishing station and the outlet end, which presents the stack to a user.

Accordingly, it is an object of the present invention to provide a paper handling system which maximizes the use of the space which it occupies; a system having a low profile to provide maximum head room; a system in which a stack of pamphlets is presented to the user at a convenient elevation above the floor of the work area; a system which provides an L-shaped path of paper travel so that it may be used with a duplicating machine having an elongated shape such that the entire system may be placed against a wall of a work area without requiring additional longitudinal space; and to provide a paper handling system in which the components have minimal complexity of construction and utilize gravity feed to eliminate additional conveying apparatus.

Other objects and advantages of the invention will be apparent from the following description, the accompanying drawings, and the appended claims.

DETAILED DESCRIPTION OF THE PREFERRED EMBODIMENT

Figure 1:
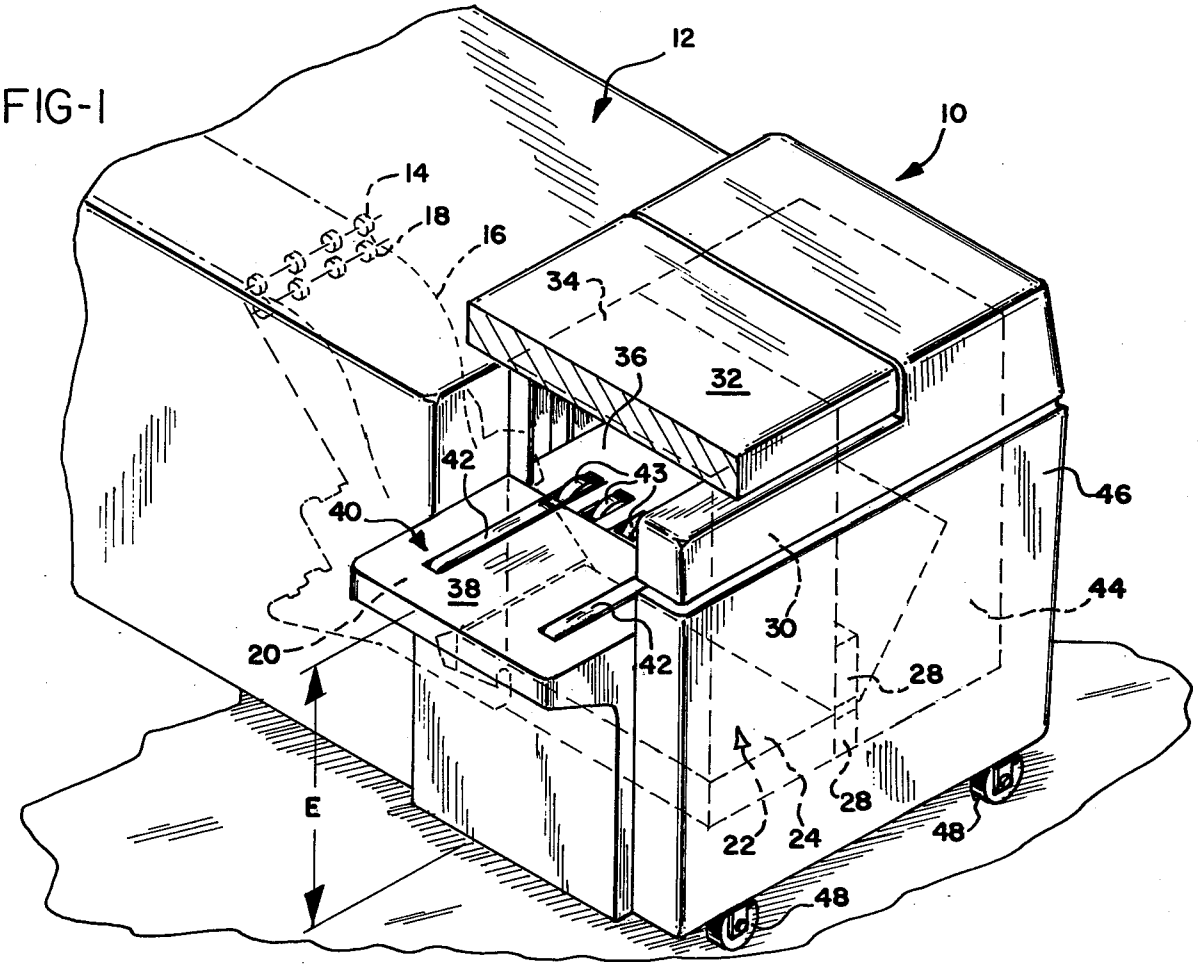
FIG. 1 is a perspective view of a preferred embodiment of the paper handling system of the present invention, showing the internal components of the embodiment in phantom.

In FIG. 1, the paper handling system of the present invention, generally designated 10, is designed to be used in combination with a conventional duplicating machine 12. Duplicating machine 12, for example, may be of the type disclosed in U.S. Pat. No. 3,685,712, which includes a sheet feed station 14 located at an upper portion of the end of the machine. The paper handling system 10 includes an accumulator 16 having an intake 18 which communicates with the sheet feed station 14 to receive sheets therefrom, and an outlet 20.

The paper handling system 10 also includes a finishing station 22 which communicates with the outlet 20 of the accumulator 16. Finishing station 22 includes a transition portion 24, which communicates directly with the outlet 20 of accumulator 16, and a stapler 28. Stapler 28 may be of a conventional variety having the appropriate size such as, for example, the stapler shown and described in U.S. Pat. Nos. 3,685,712 or 3,265,274. However, it is understood that other types of finishing apparatus may be utilized besides a stapler, such as, for example, a hole-punching apparatus.

Positioned directly above the transition portion 24 is a top-loading stacker 30. Stacker 30 includes a lid 32 which covers an upper level 34 and a tray 36 which can be indexed in a vertical direction between the upper level 34 and a discharge station 38. Discharge station 38 includes a discharge conveyor system 40 which preferably consists of a pair of belts 42 which may run from the tray 36 to the end of the discharge station. Additional rollers 43, located within the stacker 30, extend upwardly through the tray 36 to displace a stack of pamphlets to the conveyor system 40.

The stacker 30 is joined to the finishing station 22 by an elevator 44 which receives bound pamphlets from the finishing station 22 and conveys them to the upper level 34 of the stacker 30. The elevator 44 preferably is located rearwardly of the discharge station 38. The finishing station 22, elevator 44, stacker 30, and discharge station 38 preferably are housed together within a shell 46. Shell 46 may be mounted on casters 48.

Figure 2:
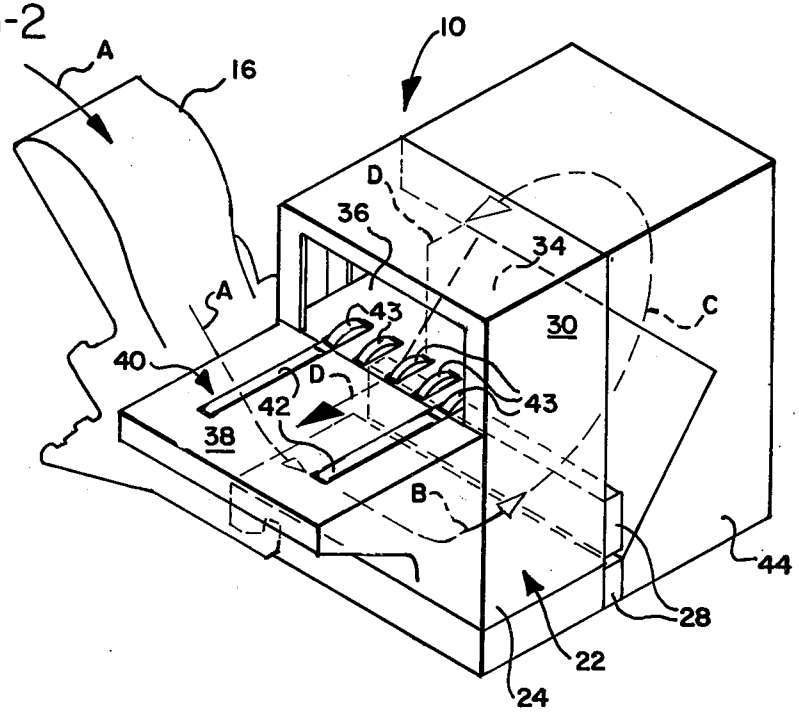
FIG. 2 is a schematic perspective representation of the preferred embodiment of FIG. 1, including arrows to indicate the path of paper travel.

As shown in FIG. 2, sheets of paper (not shown) are received by the accumulator 16 and collected into a set, then conveyed sidewardly to the finishing station 22 in a path as indicated by arrows A. Once positioned in the transition portion 24 of the finishing station 22, the set of sheets changes direction and is fed rearwardly to stapler 28, as indicated by arrow B. After being stapled, the set (now a completed pamphlet) is ejected rearwardly toward an inlet end of elevator 44. Elevator 44 carries the pamphlet along an arcuate path C which extends rearwardly, thence upwardly, and thence forwardly, all as illustrated in FIG. 2.

Figure 6:
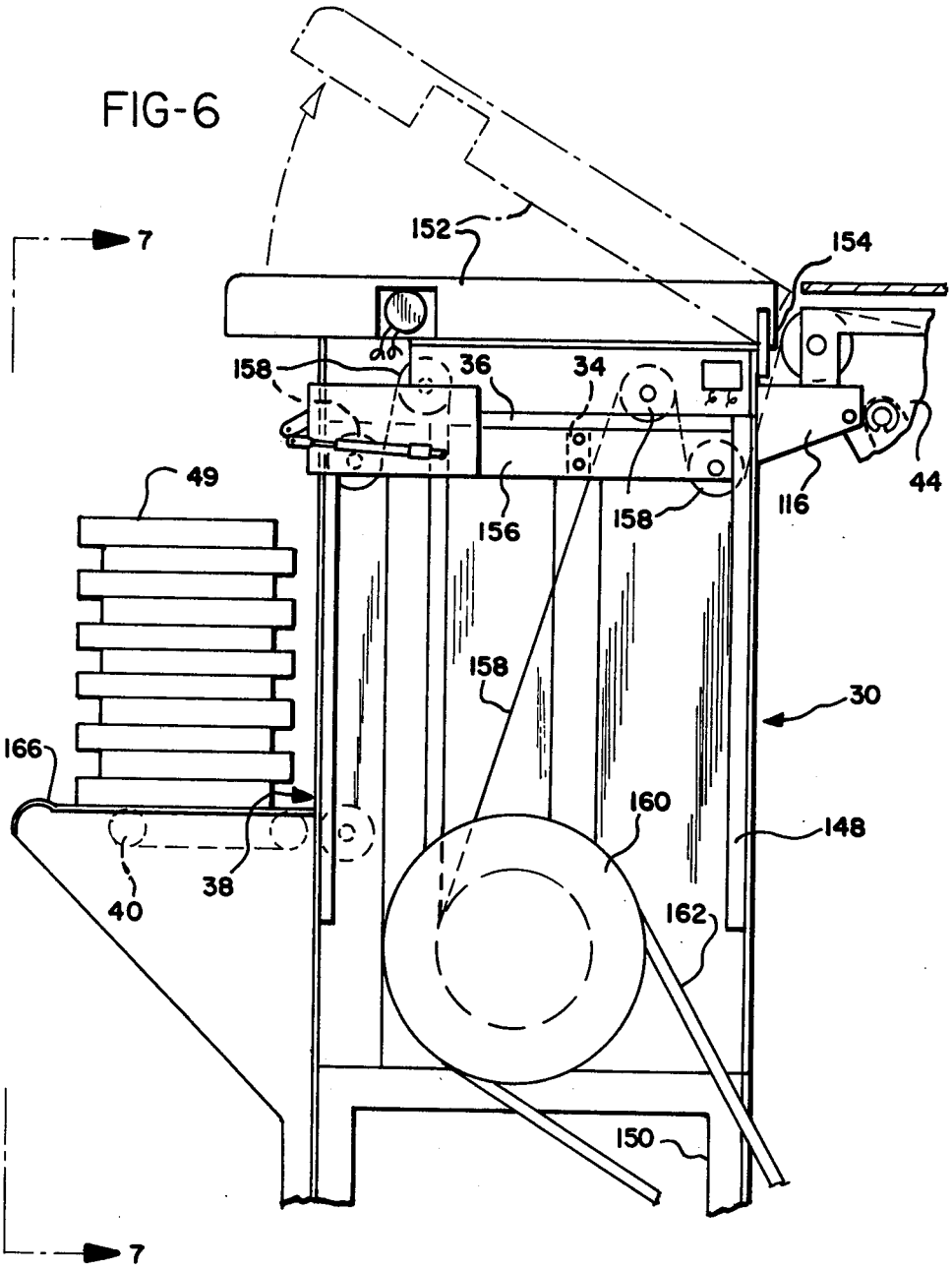
FIG. 6 is a side elevation of a stacking assembly used in the preferred embodiment of FIG. 1.
Figure 7:
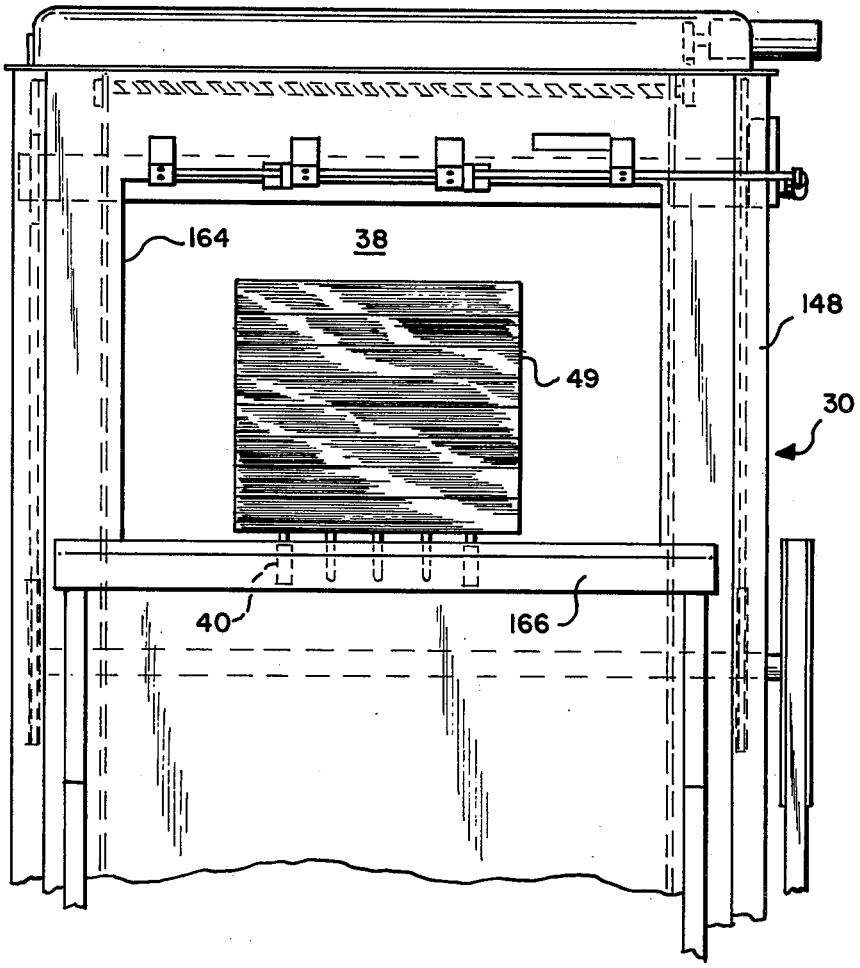
FIG. 7 is an end elevation of the stacking assembly of FIG. 6, taken at lines 7—7 of FIG. 6.

Upon reaching an outlet end of elevator 44 the pamphlet is at level 34 whereupon it is stacked on top of a stack of pamphlets 49 which may be offset as illustrated in FIGS. 6 and 7. Once in the stacker 30, the pamphlets follow a downward and forward path, indicated by arrow D.

Thus, the paper follows a highly compact path from the duplicating device, through the finishing station 22 and the stacker 30, as shown by arrow D. This paper path is desirable since it presents a finished stack of pamphlets to a user standing beside the duplicating machine 12 (shown in FIG. 1) thereby obviating the need for providing room at the ends of the combination duplicator and paper handling system 10 for access to a stack discharge opening. The overall length of the duplicator and paper handling system, and the longitudinal space required, is thus minimized.

In addition, the downward paper path, indicated by arrows to a finishing station 22, allows the finishing station to be positioned at a lower elevation than feeding station 14, thereby enabling the stacker 30 to be positioned above the finishing station without increasing substantially the overall height of the system 10. Thus, the lid 32 of the stacker 30, shown in FIG. 1, is at a height such that it may be utilized by the user as a convenient work station or provide a surface for temporarily placing other paper materials. By positioning the stapler 28 adjacent the transition portion 24, rather than in the lid 32 of the stacker, the lid of the system 10 may be made of a lightweight material and thus be easily opened. Furthermore, the stapler 28 does not add to the overall height of the system 10.

In addition, as shown in FIGS. 1 and 2, the tray 36 indexes downwardly from its upper level 34 to the discharge station 38. This presents a finished stack of bound pamphlets at an optimum height above the floor of the work area, designated by the letter E, which enables the stack to be removed easily from the discharge station.

Figure 3:
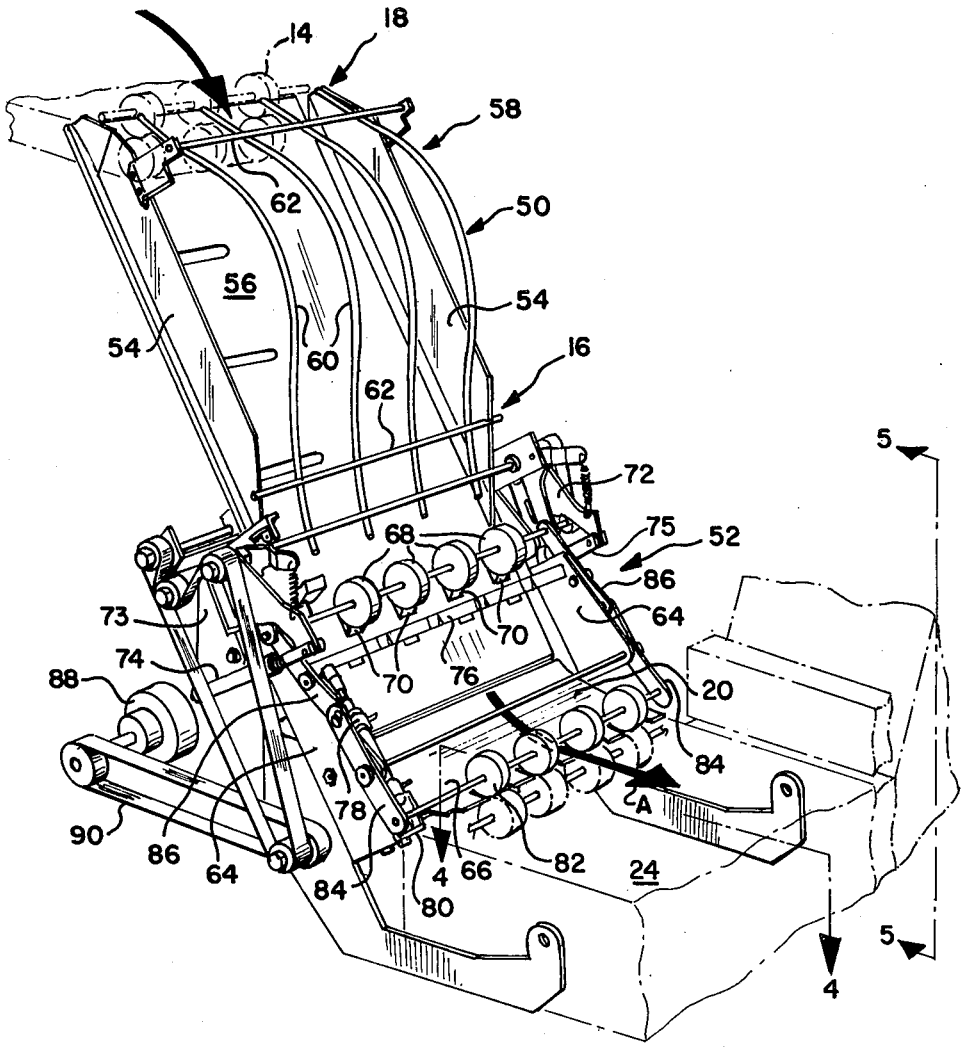
FIG. 3 is a perspective view of an accumulator used in the preferred embodiment of FIG. 1.

An accumulator 16 is shown in FIG. 3. Accumulator 16 includes a ramp 50 and a gate bracket assembly 52. Ramp 50 includes intake 18, communicating with sheet feed station 14, and gate bracket assembly 52 includes outlet 20 which communicates with transition portion 24. Ramp 50 includes downwardly converging side walls 54 joined by a floor 56. The floor 56 and side walls 54 are enclosed by guide means 58 which preferably includes a plurality of arcuately shaped wire guides 60 joined by crossbars 62 and mounted to the side walls 54. Wire guides 60 have a generally concave shape, taken in a longitudinal direction, and open downwardly toward the floor 56 of the ramp 50.

The gate bracket assembly includes side walls 64 and an arcuate shaped base 66. Floor 56 of ramp 50 extends into the gate bracket assembly 52 and abuts the arcuate base 66 proximate the outlet 20. Positioned above the floor 56 in the gate bracket assembly 52, and proximate the wire guides 60, is a set of pinch rollers 68, 70. Pinch rollers 68, 70 are supported by arms 72, 73, rotatably mounted to the gate bracket, by cylinders 74, 75 to alternately rotate toward and away from the floor 56 thereby urging pinch rollers 68, 70 toward and away from each other.

Positioned adjacent the pinch rollers 68, 70 is a gate 76 which extends across the gate bracket assembly 52 and is rotatably mounted to side wall 64. Spring-return pneumatic cylinder 78 is mounted to end wall 80 and can be activated to rotate the gate to an open or closed position.

Rearward rollers 82 are mounted on first link arms 84 which are in turn linked to second link arms 86. Second link arms 86 are connected at their ends to pinch rollers 68. The first and second link arms 84, 86 each are rotatably mounted to side walls 64 such that positioning of the pinch rollers 68 causes them to rotate the rearward rollers 82 to a position above the base 66 having the same spacing as the spacing between the pinch rollers 68 and the floor 56.

Thus, sheets of paper fed serially into the accumulator 16 from the sheet feed station 14 first encounter the guide means 58 and their leading edges are directed downwardly against the gate 76. The arcuate shape of the guides 60 causes the leading edges of the sheets to nose downwardly against the gate 76 and causes the trailing edges of the sheets to "whip" downwardly so that a sheet does not impede the travel of a subsequent sheet. Once the sheets have collected against the gate 76 in a set, pinch rollers 68, 70 are urged together by cylinders 74, 75 and the gate is rotated to an open position. Rollers 68, 70 are powered by a motor 88 which is connected to them by a pulley and belt system 90.

Pinch rollers 68, 70 are rotated to propel the set of sheets downwardly beneath the rearward rollers 82 and base 66 to the transition portion 24. Thus, the accumulator 16, which is disposed at a downwardly inclined angle to the sheet feed station 14, utilizes gravity to collect sheets in a set and eliminates the need for mechanical means to convey the sheets from the sheet feed station to the gate.

Figure 4:
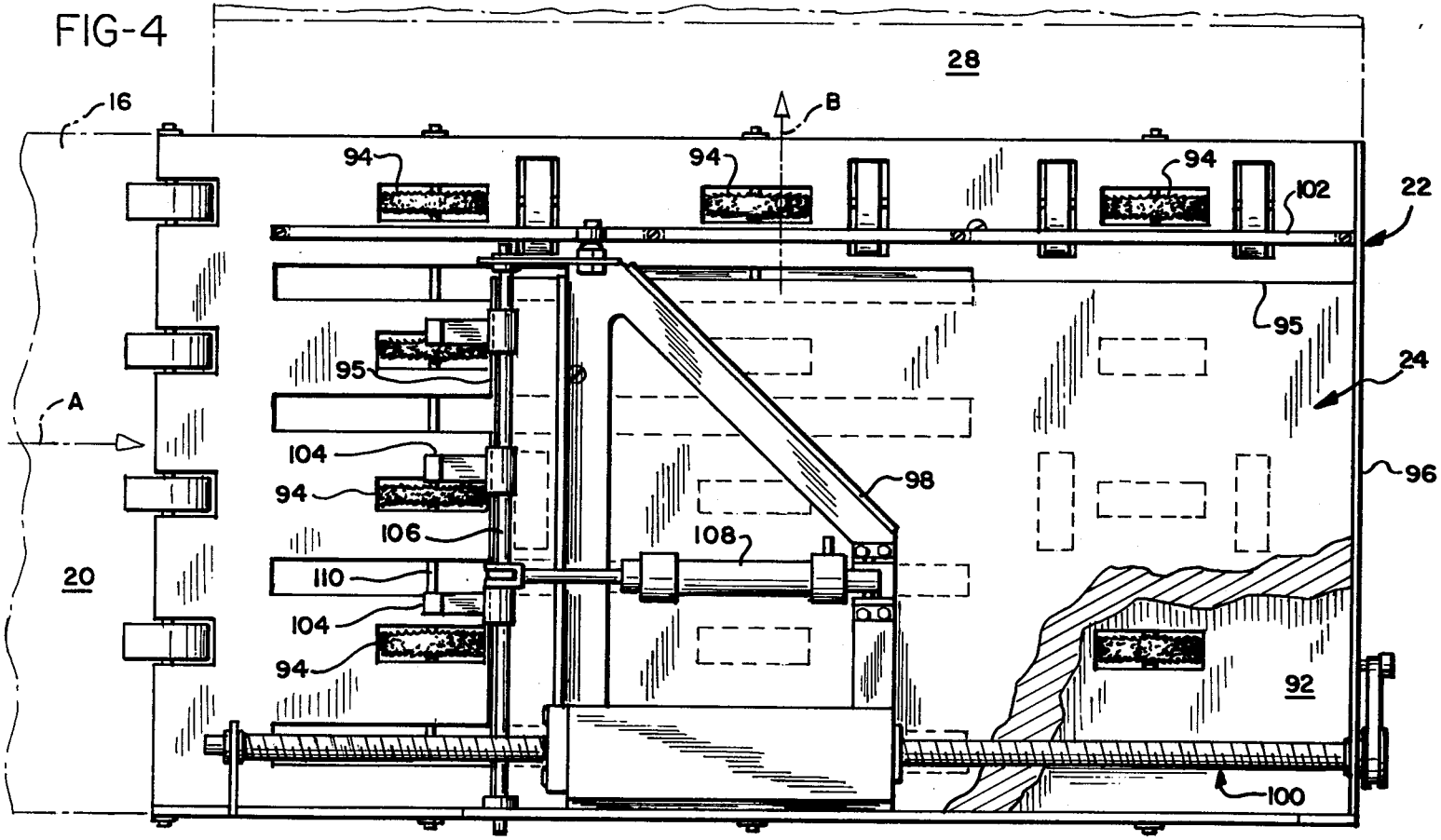
FIG. 4 is a plan view of a transition area forming a part of the finishing station of the preferred embodiment of FIG. 1 taken at line 4—4 of FIG. 3 and having arrows to show the path of paper travel.

As shown in FIG. 4, the finishing station 22 includes transition portion 24. Transition portion 24 has a floor 92 which includes a plurality of brush rollers 94 which are oriented to convey sets of sheets 95 along the floor 92 to a stop 96. The transition portion 24 is positioned to receive sets 95 from the outlet 20 of the accumulator 16 so that the leading edges of the sets abut the stop 96. Brush rollers 94 are rotated constantly during the operation of the system to maintain the position of the sets 95 against the stop 96.

A patter carriage 98 is supported above the floor 92 by a ball screw mechanism 100 and a rail 102 which is mounted to the sides of the transition portion 24 by conventional structure (not shown). The patter carriage 98 includes a plurality of patter fingers 104 mounted on an axle 106 rotatably mounted to the patter carriage. A spring-return pneumatic cylinder 108 is rotatably mounted to the patter carriage 98 and is joined to the axle 106 by link arm 110. Extension of the cylinder 108 causes the patter fingers 104 to be rotated downwardly to engage the trailing edge of the set of sheets 95 abutting the stop 96 and supported by the floor 92. During the operation of the paper handling system, the cylinder 108 is cycled two or three times for each set 95, thus rotating the patter fingers 104 downwardly two or three times to maintain proper registration of the sheets forming the set.

The transition portion 24 also includes a plurality of rollers 112 which protrude upwardly from the floor 92 and are oriented substantially normal to the brush rollers 94. Rollers 112 are carried by structure (not shown) such that they are capable of being raised above the floor 92 or dropped below it. Once a set of sheets has engaged the stop 96, rollers 112 are raised above the base 92 to transport the set to the stapler 28 rearwardly in the direction of arrow B.

Figure 5:
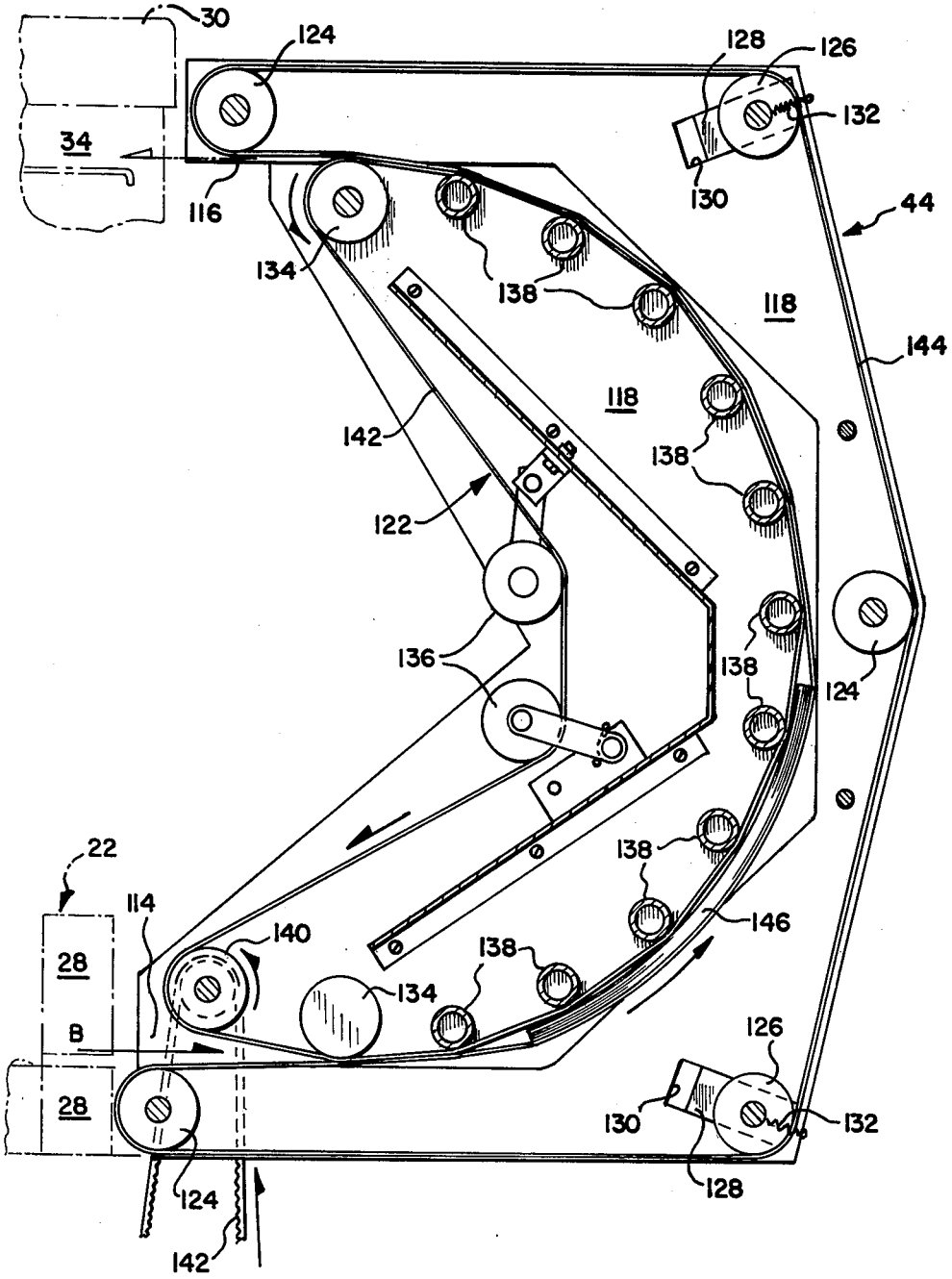
FIG. 5 is a side elevation of an elevator used in the embodiment of FIG. 1 and taken at line 5—5 of FIG. 3.

As shown in FIG. 5, the elevator 44 includes an inlet 114 which communicates with the stapler 28 and an outlet 116 which communicates with the upper level 34 of stacker 30. Elevator 44 includes a frame 118 which supports an outer belt assembly 120 and an inner belt assembly 122. Outer belt assembly 120 includes fixed idler rollers 124 and tension rollers 126. Tension rollers 126 are mounted on blocks 128 which slidably engage recesses 130 formed in the frame 118 and are biased outwardly by extension springs 132.

Inner belt assembly 122 includes fixed rollers 134, tension rollers 136, and tube rollers 138. Inner belt assembly 122 also includes a drive roller 140 which is driven by a timing belt 142 connected to a motor (not shown).

It is understood that, although the elevator 44 shown in FIG. 5 shows one of each of the above-mentioned rollers at each location, there is in reality a plurality of rollers at each location extending across the width of the elevator. The location and shape of the rollers not shown are identical to the rollers depicted. However, in the case of the tube rollers 138, each roller is in the shape of a hollow tube which extends across the width of the elevator 44. Therefore, only one tube roller 138 is positioned at each location shown in FIG. 5.

The rollers of the inner belt assembly 122 are joined by a plurality of inner belts 142, and the rollers of the outer belt assembly 120 are joined by a plurality of outer belts 144. Both the inner belts 142 and the outer belts 144 travel in an arcuate path as they traverse the tube rollers 138. A pamphlet 146, received from the stapler 28 of the finishing station 22, travels along the arcuate path and is compressed between the inner and outer belts 142, 144. Thus, in transporting a pamphlet 146 from the finishing station 22 to the upper level 34 of stacker 30, the pamphlet is inverted such that the topmost sheet of the pamphlet at the finishing station becomes the bottom sheet at the stacking station.

As shown in FIGS. 6 and 7, the stacker 30 includes a frame 148 which rests upon a support 150 within which may be mounted the finishing station components (not shown). The frame 148 includes a lid 152 which is connected to the top of the stacker 30 by hinges 154. Lid 152 preferably is positioned within lid 32 (FIG. 1) and operates as a unit. Alternatively, lids 32, 152 may be one and the same. The stacking station 34 is also located at the top of the stacker 30 and communicates with the outlet 116 of the elevator 44.

A tray carriage 156, which supports tray 36, is adjustably mounted within the frame 148 and may be positioned therein by a cable and pulley system 158. Cable and pulley system 158 is connected to a drive pulley 160 which is rotated by a timing belt 162 driven by a motor (not shown). As shown in FIG. 7, the frame 148 defines an opening 164 which comprises the discharge station 38. The discharge station 38 also includes a shelf 166 which is attached to and extends outwardly from the frame 148 and is positioned at the bottom of the opening 164. Shelf 166 supports the discharge conveyor 40. Shelf 166 preferably is enclosed within shell 46 (FIG. 1).

In operation, bound pamphlets 146 are fed into the stacking station 34 by the elevator 44 where they are placed upon the tray 36. Tray 36 is indexed downwardly with the carriage 156 by the cable and pulley system 158 as additional pamphlets are placed upon the tray. After the pamphlets have been stacked upon tray 36, the tray is indexed downwardly to a position where the top of the tray is coplanar with the shelf 166 of the discharge station 38. The discharge conveyor 40 is then activated to transport the stack 168 from tray 36 to the shelf 166 where it may be removed to a remote location by the user. Preferably, the stacker 30 includes offset stacking components (not shown) so that the resultant stack 168 may be separated into the individual pamphlets or grouped sets of pamphlets with relative ease.

While the form of apparatus herein described constitutes a preferred embodiment of this invention, it is to be understood that the invention is not limited to this precise form of apparatus, and that changes may be made therein without departing from the scope of the invention.

What is claimed is:

1. For use with a duplicating device of the type having printing means for imparting an image onto single sheets of paper, and conveying means including a sheet feed station for conveying sheets from the printing means to the sheet feed station, a paper handling system comprising:

a gravity feed accumulator for receiving sheets serially from a sheet feed station and collecting them into a set, said accumulator having an intake for communicating with a sheet feed station to receive sheets therefrom, an outlet, positioned at a lower elevation than and sidewardly from said intake, through which sets of collected sheets leave said accumulator, and means joining said intake and said outlet and positioned at an elevation therebetween, for repetitively accumulating sheets entering said intake into a set and conveying sets sidewardly from said intake to said outlet;

a finishing station positioned below said intake and communicating with said outlet, said finishing station having transition means for conveying sets sidewardly from said outlet then rearwardly;

elevator means having an inlet end located rearwardly of and communicating with said transition means, means for conveying pamphlets upwardly from said inlet, and an outlet end located above said inlet for conveying pamphlets forwardly from said conveying means;

top-loading stacker means superposed to said finishing station and having an upper level communicating with said outlet end, a substantially horizontal tray and means for indexing said tray in a vertical direction downwardly from said upper level such that a first bound pamphlet may be conveyed forwardly from said outlet means, placed upon said tray at said upper level, and said table indexed downwardly repeatedly so that successive pamphlets may be stacked one on top of another; and discharge conveyor means communicating with said stacker means and said tray and having a discharge station positioned exteriorly and forwardly of said stacker means for transporting a stack of bound pamphlets from said tray to said discharge station, said discharge station being located at an elevation intermediate the elevations of said upper level and said finishing station.

2. The paper handling system of claim 1 wherein said joining means includes downwardly inclined ramp means for transporting sheets by gravity from said intake to said outlet.

3. The paper handling system of claim 2 wherein said upper level is located at an elevation above the elevation of said accumulator intake.

4. The paper handling system of claims 1, 2, or 3 wherein said finishing station includes means for binding sets of sheets into pamphlets.

5. For use with a duplicating system which produces sets of printed sheets in serial paginated sequence for binding into pamphlet form, a paper handling system comprising:

receiving means for receiving printed sheets;

accumulator means located adjacent said receiving means for accumulating sheets into pamphlet-defining sets;

conveying means for conveying sets one at a time, as accumulated, sidewardly away from said accumulator;

finishing means for receiving sets of sheets sidewardly from said conveyor means and ejecting sets of sheets received in a rearward direction;

elevator means having an inlet end and an outlet end for receiving sets of sheets ejected rearwardly from said finishing means through said inlet end and conveying sets of sheets along an arcuate path which extends rearwardly from said inlet, thence upwardly, and thence forwardly through said outlet end;

stacking means substantially superposed to said finishing means including a substantially horizontal tray for receiving sets of sheets from said outlet end of said elevator means and stacking sets into a stack upon said tray while lowering said tray to maintain a top surface of a stack upon said tray level with said outlet end of said elevator means;

discharge means having an elevation intermediate said conveying means and said outlet end for removing a stack from said tray and discharging a removed stack in a forward direction; and a shelf substantially coplanar with said discharge means for receiving a removed stack from said discharge means and presenting a removed stack to a user.

6. The paper handling system of claim 5 wherein said finishing means includes means for binding sets of sheets into pamphlets.

7. The paper handling system of claim 6 wherein said finishing means includes stop means for stopping sets of sheets received from said conveying means at a stopping position adjacent said binding means, and second conveying means for transporting sets of sheets rearwardly from said stopping position to said binding means and thence to said inlet end of said elevating means.

8. The paper handling system of claims 5, 6, or 7 wherein said receiving means are downwardly directed and said accumulator means are located at a lower end of said receiving means.

* * * * *